US005758524A

United States Patent [19]

Yu

[11] Patent Number: 5,758,524

[45] Date of Patent: Jun. 2, 1998

[54] HANDLE-MOUNTED LOCKING APPARATUS AND METHOD

[76] Inventor: Sandy Tai Sheung Yu, 8640 Heather Street, Richmond, British Columbia, Canada, V6Y 2R5

[21] Appl. No.: 621,783

[22] Filed: Mar. 22, 1996

[51] Int. Cl.[6] ..... E05B 47/00

[52] U.S. Cl. ..... 70/276; 70/413; 70/472; 292/251.5; 42/70.11

[58] Field of Search ..... 70/276, 413, 472, 70/142, 218, 223, 202; 292/251.5; 42/70.11

[56] References Cited

U.S. PATENT DOCUMENTS

| | | | |
|---|---|---|---|
| 3,785,188 | 1/1974 | Drathschmidt | 70/276 |
| 3,857,262 | 12/1974 | Sidiropoulos | 70/276 |
| 3,967,479 | 7/1976 | Vick | 70/276 |
| 3,974,669 | 8/1976 | Stackhouse | 70/276 |
| 4,003,152 | 1/1977 | Barker et al. | 42/70 R |
| 4,067,132 | 1/1978 | Smith | 42/66 |
| 4,105,885 | 8/1978 | Orenstein | 200/52 R |
| 4,135,320 | 1/1979 | Smith | 42/70 R |
| 4,154,014 | 5/1979 | Smith | 42/70 R |
| 4,307,589 | 12/1981 | Kajita | 70/276 |
| 4,354,189 | 10/1982 | Lemelson | 340/825.31 |
| 4,416,127 | 11/1983 | Gomez-Olea Naveda | 70/276 |
| 4,457,091 | 7/1984 | Wallerstein . | |
| 4,467,545 | 8/1984 | Shaw, Jr. | 42/70 R |
| 4,488,370 | 12/1984 | Lemelson | 42/70 R |
| 4,682,435 | 7/1987 | Heltzel | 42/70.01 |
| 5,016,376 | 5/1991 | Pugh | 42/70.11 |
| 5,062,232 | 11/1991 | Eppler | 42/70.11 |
| 5,123,193 | 6/1992 | Pugh | 42/70.11 |
| 5,192,818 | 3/1993 | Martin | 42/70.01 |
| 5,303,495 | 4/1994 | Harthcock | 42/84 |
| 5,377,513 | 1/1995 | Miyamoto et al. | 70/276 |
| 5,394,717 | 3/1995 | Yu | 70/276 |
| 5,408,777 | 4/1995 | Brooks | 42/70.11 |
| 5,433,028 | 7/1995 | Novak et al. | 42/70.06 |
| 5,437,119 | 8/1995 | Womack | 42/70.07 |
| 5,457,907 | 10/1995 | Brooks | 42/70.11 |
| 5,461,812 | 10/1995 | Bennett | 42/70.11 |
| 5,502,915 | 4/1996 | Mendelsohn et al. | 42/70.11 |
| 5,564,211 | 10/1996 | Mossberg et al. | 42/70.11 |

FOREIGN PATENT DOCUMENTS

| | | | |
|---|---|---|---|
| 0262262 | 4/1988 | European Pat. Off. | E05B 47/06 |
| 1297090 | 8/1961 | France . | |
| 8334889 | 7/1985 | Germany . | |
| 23564 | 8/1910 | United Kingdom . | |
| P06956 | 2/1915 | United Kingdom . | |

OTHER PUBLICATIONS

Magazine: *Shooting Times:* Article Title: *Colt's "Smart Gun"*; pp. 42–44; Jan. 1997; Published in the United States; Author: Staff Report.

(List continued on next page.)

*Primary Examiner*—Suzanne Dino
*Attorney, Agent, or Firm*—Christie, Parker & Hale, LLP

[57] ABSTRACT

A locking apparatus for use on a handle operable to be gripped by a user's hand. The apparatus includes a moveable actuator operable to be moved by a portion of a user's hand when gripping the handle. A first moveable blocking member is connected to the handle and is operable to be moved into an enabling position in which movement of the movable actuator is enabled and is operable to be moved into a blocking position in which movement of the actuator is blocked by the blocking member interfering with movement of the actuator. A first mounted magnet is connected to the first blocking member and is disposed in a position on the handle such that at least one of the user's fingers will be adjacent the first mounted magnet when the handle is gripped. The first mounted magnet is operable to cooperate with a first adjacent magnet placed adjacent the first mounted magnet to move the first blocking member between the blocking and enabling positions. A method of unlocking an actuator on a handle includes gripping the handle such that an adjacent magnet on a finger ring worn by the user is placed adjacent a mounted magnet on the handle, attracting the mounted magnet with the adjacent magnet thereby moving a first blocking member out of the path of an actuator on the handle and squeezing the handle and the actuator to move the actuator relative to the handle.

28 Claims, 8 Drawing Sheets

OTHER PUBLICATIONS

Magazine: *Stocking Firearms Dealer Magazine;* New Product Summaries; pp. 25 and 26; Jan. 1997; No author; Published in the United States.

Magazine: *Stocking Firearms Dealer Magazine:* Advertisement for Saf–T–Blok; p. 33; Jan. 1997; No author; Published in the United States.

HANDLE-MOUNTED LOCKING APPARATUS AND METHOD

BACKGROUND OF THE INVENTION

This invention relates to actuator locking devices for use on apparatuses having a handle with an actuator thereon or nearby, such that when the handle is used the actuator may be operated. Actuator locking devices of this type have particular application on briefcases, hand-carried devices and on firearms, and more particularly on handguns, pistols and the like.

Various device are known in the art for controlling or locking the operation of a mechanism. In the field of firearms for example, various devices have been devised for controlling the operation of a firearm and more particularly for preventing the unauthorized use of the firearm. One device, in particular, has been patented by Smith in U.S. Pat. No. 4,154,014 which discloses a magnetically actuable safety apparatus which includes a resilient member operable to be deflected to one side or the other in response to proximity of a magnetic ring worn by a user. This requires the magnetic fields of a magnet on the ring and a magnet on the apparatus to interact to physically move a member into or out of interference with the operation of a mechanism. The magnetic fields must therefore be strong enough to move the member, despite any frictional obstructions. Placement of the magnetic ring must therefore be reasonably accurate. This renders this type of device sensitive to ring positioning and can lead to unreliable operation.

For this and various other reasons, it would be desirable to provide a locking device which employs a ring magnet to enable or disable operation of a lock but which employs the force of a user's hand squeezing a handle to move members which cooperate with the mechanism to be locked to control the locking thereof.

SUMMARY OF THE INVENTION

In accordance with one aspect of the invention, there is provided a locking apparatus for use on a handle operable to be gripped by a user's hand. The apparatus includes a moveable palm-actuated actuator operable to be moved by a user's palm when gripping the handle. A first moveable blocking member is connected to the handle and is operable to be moved into an enabling position in which movement of the movable actuator is enabled and is operable to be moved into a blocking position in which movement of the moveable actuator is blocked by the blocking member interfering with movement of the palm-actuated actuator. A first mounted magnet is connected to the first blocking member and is disposed in a position on the handle such that at least one of the user's fingers will be adjacent to the first mounted magnet when the handle is gripped. The first mounted magnet is operable to cooperate with a first adjacent magnet placed adjacent to the first mounted magnet to move the first blocking member between the blocking and enabling positions.

The actuator may include a palm-actuated actuator operable to be moved by a user's palm when gripping the handle and the palm actuated actuator may be movably connected to the handle such that when the handle is squeezed, the palm actuated actuator is moved relative to the handle.

The apparatus may further include a first position, for positioning at least one of the user's fingers in proximity to the first mounted magnet such that when the adjacent magnet is on a first ring worn on that finger, the first adjacent magnet is disposed in proximity to the first mounted magnet when that finger is located in the first positioner. The first positioner may be disposed on the palm-actuated actuator or directly on the handle.

A first hinge may be used for hingedly connecting the first blocking member to the handle. Preferably, the first mounted magnet is mounted to the first blocking member such that the first blocking member is pivoted about the first hinge when the first adjacent magnet is proximal to the first mounted magnet.

The first mounted magnet and the first adjacent magnet may have opposite polarities such that the first mounted magnet is attracted to the first adjacent magnet to cause the blocking member to move into the blocking position. Or, the first mounted magnet and the first adjacent magnet may have like polarities such that the first mounted magnet is repelled from the first adjacent magnet to cause the blocking member to move into the enabling position.

Preferably, the apparatus further includes a ready indicator on said handle, the ready indicator being operable to be extended when the palm actuated actuator is fully actuated, to provide tactile feedback to the user to indicate same.

The apparatus may further include a second moveable blocking member connected to the handle and operable to be moved into an enabling position, in which movement of the movable actuator is enabled, and into a blocking position in which movement of the moveable actuator is blocked. A second mounted magnet may be mounted on the second blocking member, the second mounted magnet being operable to cooperate with a second adjacent magnet placed adjacent thereto such that the second blocking member is moved between the enabling and blocking positions.

The apparatus may include a second positioner for positioning at least one of the user's fingers in proximity to the second magnet.

A second hinge may hingedly connect the second blocking member to the handle.

Preferably, the second mounted magnet and the second adjacent magnet have opposite polarities such that the second mounted magnet is attracted to the second adjacent magnet to cause the blocking member to move into the enabling position. Or, the second mounted magnet and the second adjacent magnet have like polarities such that the second mounted magnet is repelled from the second adjacent magnet to cause the blocking member to move into the enabling position. Or, the first mounted magnet and the first adjacent magnet may have opposite polarities such that the first mounted magnet is attracted to the first adjacent magnet to cause the first blocking member to move into the enabling position and the second mounted magnet and the second adjacent magnet have like polarities such that the second mounted magnet is repelled from the second adjacent magnet to cause the second blocking member to move into the enabling position. Or, the first mounted magnet and the first adjacent magnet may have like polarities such that the first mounted magnet is repelled from the first adjacent magnet to cause the blocking member to move into the enabling position and the second mounted magnet and the second adjacent magnet have opposite polarities such that the second mounted magnet is attracted to the second adjacent magnet to cause the blocking member to move into the enabling position.

In accordance with another aspect of the invention, there is provided a locking apparatus for use on a handle operable to be gripped by a user's hand. The apparatus includes a palm-actuated actuator movably connected to the handle, such that when the handle is squeezed, the palm actuated actuator is moved relative to the handle. The apparatus further includes first and second moveable blocking members movably connected to the handle, the first and second movable blocking members being operable to be moved into respective enabling positions, in which movement of the movable actuator is enabled, and into respective blocking positions in which movement of the palm-actuated actuator is blocked. First and second mounted magnets are on the first and second blocking members respectively, the first and second mounted magnets being operable to cooperate with first and second adjacent magnets respectively when the first and second adjacent magnets are placed adjacent thereto such that the first and second blocking members are moved between the enabling and blocking positions.

Preferably, the apparatus includes first and second positioners on the handle, for positioning two of the user's fingers in proximity to the first and second mounted magnets respectively, such that when the adjacent magnets are on first and second rings worn on the two of the user's fingers, the first and second adjacent magnets are disposed in proximity to the first and second mounted magnets respectively when the two of the user's fingers are located in the first and second positioners respectively.

In accordance with another aspect of the invention, there is provided a method of unlocking an actuator on a handle including the steps of gripping the handle such that an adjacent magnet on a finger ring worn by the user is placed adjacent a mounted magnet on the handle, attracting the mounted magnet with the adjacent magnet thereby moving a first blocking member out of the path of a palm-actuated actuator on the handle and squeezing the handle and the palm-actuated actuator to move the palm-actuated actuator, relative to the handle.

In accordance with another aspect of the invention, there is provided a gun having a handle and a safety mechanism, a moveable actuator on the handle, the moveable actuator being operable to actuate the safety mechanism. A first moveable blocking member is connected to the handle and is operable to be moved into an enabling position in which movement of the movable actuator is enabled and a blocking position in which movement of the moveable actuator is blocked by the blocking member interfering with movement of the palm-actuated actuator. A first mounted magnet is connected to the first blocking member and is disposed in a position on the handle such that at least one of the user's fingers will be adjacent said first mounted magnet when the handle is gripped. The first mounted magnet is operable to cooperate with a first adjacent magnet placed adjacent thereto to move the first blocking member between the blocking and enabling positions.

In accordance with another aspect of the invention, there is provided a locking apparatus for use on a device having a handle operable to be gripped by a user's hand. The apparatus comprises a moveable thumb-actuated actuator operable to be moved by a user's thumb when gripping the handle and operable to actuate a the device. It also comprises a first moveable blocking member connected to the handle and operable to be moved into an enabling position in which movement of the movable actuator is enabled and a blocking position in which movement of the thumb-actuated actuator is blocked by the blocking member interfering with movement of the thumb-actuated actuator and a first mounted magnet connected to the first blocking member and disposed in a position on the handle such that at least one of the user's fingers will be adjacent the first mounted magnet when the handle is gripped, the first mounted magnet being operable to cooperate with a first adjacent magnet placed adjacent thereto to move the first blocking member between the blocking and enabling positions.

Preferably, the thumb actuated actuator is movably connected to the handle such that when the user's thumb is retracted relative to the handle, the thumb actuated actuator is moved relative to the handle.

Preferably, the apparatus includes a first positioner, for positioning at least one of the user's fingers in proximity to the first mounted magnet such that when the adjacent magnet is on a first ring worn on the at least one of the user's fingers, the first adjacent magnet is disposed in proximity to the first mounted magnet when the at least one of the user's fingers is located in the first positioner. Preferably, the positioner is on the handle.

In accordance with another aspect of the invention, there is provided an article of luggage having a handle and first and second separable portions, the handle being connected to at least one of the first and second separable portions, a moveable thumb-actuated actuator operable to be moved by a user's thumb when gripping the handle, a latch on at least one of the separable portions, and a hook connected to the thumb actuated actuator and operable to engage the latch when the thumb actuated actuator is in a rest position and operable to disengage the latch when the thumb actuated actuator is in an actuated position. The article of luggage further includes a first moveable blocking member connected to the handle and operable to be moved into an enabling position in which movement of the movable thumb-actuated actuator is enabled and a blocking position in which movement of the thumb-actuated actuator is blocked by the blocking member interfering with movement of the thumb-actuated actuator and a first mounted magnet connected to the first blocking member and disposed in a position on the handle such that at least one of the user's fingers will be adjacent the first mounted magnet when the handle is gripped, the first mounted magnet being operable to cooperate with a first adjacent magnet placed adjacent thereto to move the first blocking member between the blocking and enabling positions.

The invention requires more than just positioning of a magnetic ring worn by user to operate the lock. It also requires that the user squeeze an actuator and the handle together in order to enable the locked mechanism to be operated. When used on a firearm, this renders the firearm inoperable unless the user is wearing a ring of appropriate polarity and is holding the firearm in a specific position in which the handle is properly gripped. By ensuring the proper grip on the firearm, the firearm is rendered safer to use, even when used by an authorized user. The simplicity of the device and its ability to block movement of an existing mechanism render it particularly useful in retrofit applications.

In general, the invention provides a locking device and method which employs a ring magnet to enable or disable operation of a lock but which employs the force of a user's hand or thumb squeezing a handle to move members which cooperate with the mechanism to be locked to control the locking thereof.

BRIEF DESCRIPTION OF THE DRAWINGS

In drawings which illustrate embodiments of the invention.

DETAILED DESCRIPTION

Figure 1:
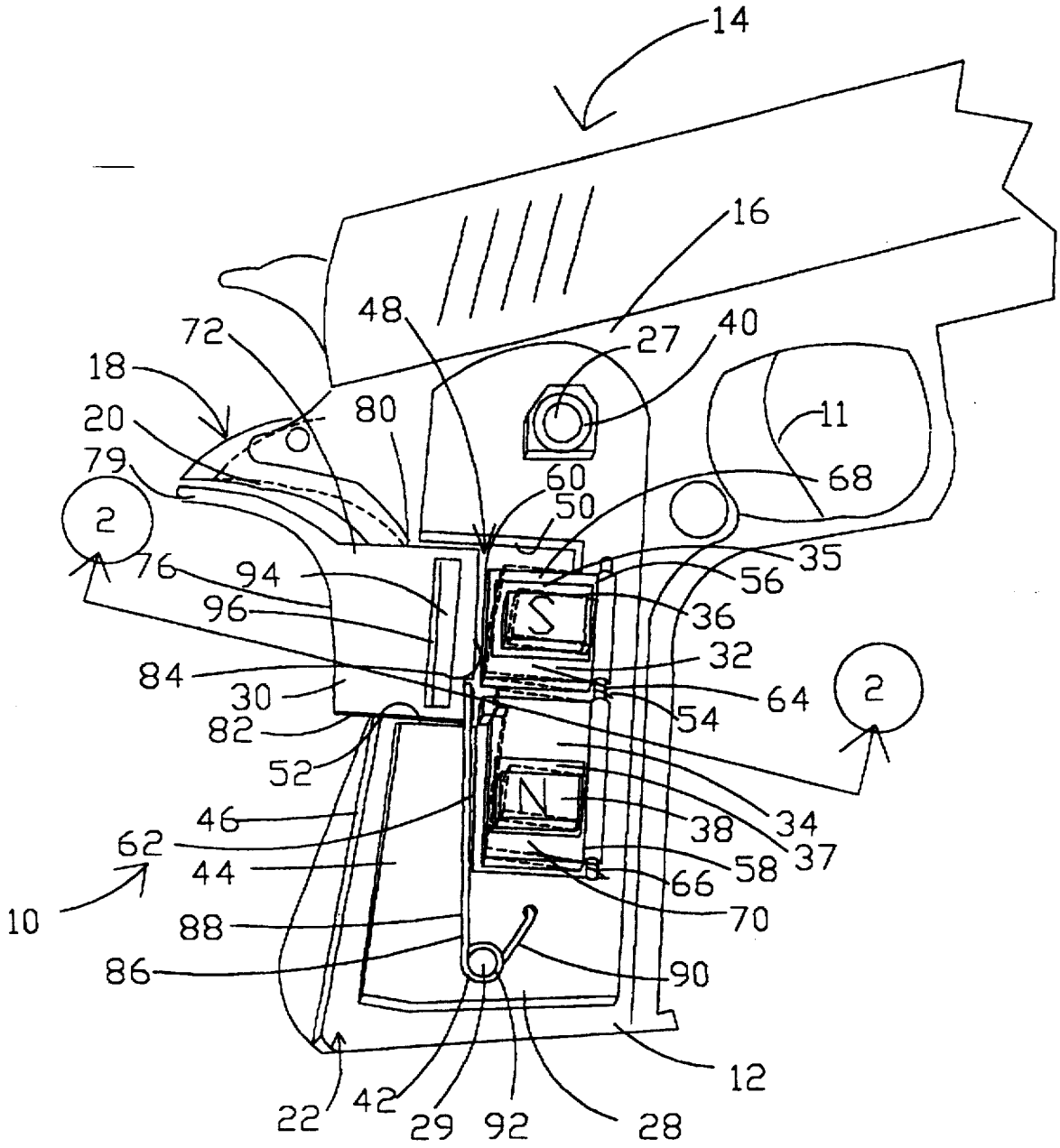
FIG. 1 is a fragmented side view of a pistol upon which an apparatus according to a first embodiment is installed.

Referring to FIG. 1, an apparatus according to a first embodiment of the invention is shown generally at 10. The apparatus is a locking apparatus for use on a handle operable to be gripped by a user's hand. In this embodiment, the apparatus is shown mounted on a handle 12 of a gun 14, in this case a Colt 1911 A1 pistol, however, it will be appreciated that the apparatus could be mounted on other devices having handles, such as briefcases or the like.

The Colt 1911 A1 pistol is of the type having a frame 16, and a grip safety mechanism shown generally at 18, the grip safety mechanism including a grip safety actuator 20 mounted at a rearward portion 22 of the handle 12. The grip safety mechanism is conventional and renders the pistol operational when the grip safety actuator 20 is squeezed into the handle 12, into the position shown in broken outline in FIG. 1 and renders the pistol inoperational when the grip safety actuator 20 is in a rest position shown in solid outline.

In the present embodiment, the apparatus 10 is used to inhibit or enable the squeezing action of the user's hand to be transmitted to the grip safety actuator 20, and hence the operation of the pistol is controlled by the apparatus.

It is a particular advantage of the apparatus that it can be retrofitted to an existing pistol of the type described, or the apparatus may be installed on a pistol as part of its assembly process at the time of manufacture.

Figure 2:
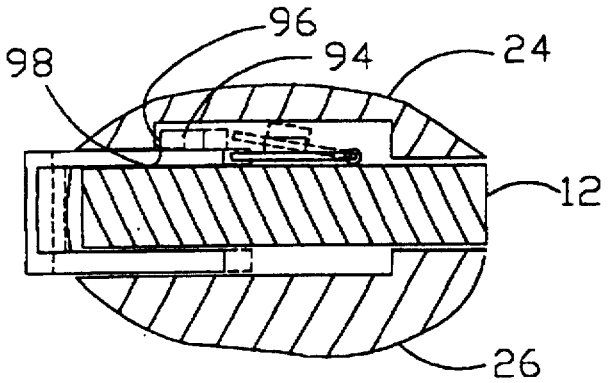
FIG. 2 is a cross-sectional view of a handle portion of the pistol of FIG. 1, taken along lines 2—2 of FIG. 1.

Referring to FIG. 2, to retrofit the apparatus to the pistol shown, first and second conventional plastic covers 24 and 26, are removed from opposite sides of the pistol handle 12. Referring to FIG. 1, this exposes first and second mounting bosses 27 and 29 on each side of the handle, only one side being shown in FIG. 1.

In this embodiment, the apparatus includes a mounting plate 28, a moveable palm-actuated actuator 30 operable to be moved by a user's palm when gripping the handle 12, and first and second moveable blocking members 32 and 34 connected to the mounting plate 28 and operable to block movement of the moveable palm-actuated actuator 30. The apparatus further includes first and second mounted magnets 36 and 38 on the first and second blocking members 32 and 34 for selectively moving the first and second blocking members to selectively block the palm-actuated actuator 30.

The mounting plate 28 has first and second openings 40 and 42 disposed at opposite end portions thereof, for receiving the first and second mounting bosses 27 and 29 respectively, to locate and position the mounting plate on the handle 12 of the pistol. The mounting plate 28 is relatively thin so that the covers (24 and 26 of FIG. 2) can be re-installed on the handle 12 over the mounting plate and components mounted thereon without interfering therewith.

Still referring to FIG. 1, the mounting plate 28 has a first side portion 44 having a main perimeter edge 46. A guide portion is formed in the main perimeter edge and is comprised of a notch 48 defined by first and second oppositely disposed perimeter edge portions 50 and 52.

Opposite the notch 48, the mounting plate 28 has a hinge portion 54 which hingedly connects the first and second blocking members 32 and 34 to the mounting plate. As the mounting plate 28 is ultimately connected to the handle 12, the hinge portion acts as first and second hinges for hingedly connecting the first and second blocking members 32 and 34 to the handle 12. The first and second blocking members 32 and 34 have respective hinge edges 56 and 58 connected to the hinge portion 54 and have blocking edges 60 and 62 opposite to the hinge edges, which extend in the notch 48, between the first and second perimeter edge portions 50 and 52. The first and second blocking plates are urged into the positions shown in solid outline in FIG. 1, by first and second springs 64 and 66 respectively.

The first and second blocking members 32 and 34 have respective first and second flat faces 68 and 70 to which are mounted the first and second mounted magnets 36 and 38 respectively. The first mounted magnet 36 is oriented and secured to the first blocking member 32 such that a south pole thereof faces away from the first blocking member 32 while the second mounted magnet 38 is oriented and secured to the second blocking member 34 such that a north pole thereof faces away from the second blocking member 34. First and second ferrous plates 35 and 37 are secured between the first mounted magnet 36 and the first blocking member 32 and between the second mounted magnet 38 and the second blocking member 34 respectively to focus the magnetic fields produced by the first and second mounted magnets to prevent the first and second mounted magnets from being attracted to the metallic handle 12 of the gun 14.

Figure 3:
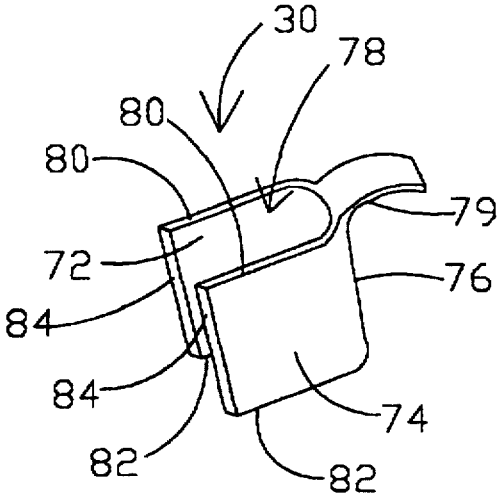
FIG. 3 is a perspective view of a palm actuator according to the first embodiment.

Referring to FIG. 3, the palm-actuated actuator 30 includes a U-shaped member having first and second spaced apart leg portions 72 and 74 connected together by a hand contacting portion 76. A U-shaped space 78 is therefore formed between the first and second leg portions 72 and 74. Referring back to FIG. 1, a rearward portion 22 of the handle 12 is received in the U-shaped space 78 such that the first and second leg portions 72 and 74 are received on opposite sides of the handle 12 and act to guide the palm-actuated actuator 30 in linear movement relative to the handle. Hence, the palm actuated actuator 30 is movably connected to the handle 12 such that when the handle is squeezed, the palm-actuated actuator 30 is moved relative to the handle.

The hand contacting portion 76 has a first positioner 79 for cooperating with the user's hand such that the user's middle finger and fourth finger will be in proximity to the first and second mounted magnets 36 and 38 on the handle 12 of the pistol when the handle is gripped by the right hand of the user. Thus, the first position is disposed on the palm-actuated actuator.

Referring back to FIG. 3, each of the first and second leg portions 72 and 74 has respective first and second oppositely disposed edges 80 and 82 and an abutting edge 84 extending between the first and second edges. Referring back to FIG. 1, the first leg portion 72 is received in the notch 48 such that the first and second edges 80 and 82 thereof are further guided by the first and second edge portions 50 and 52 of the notch respectively, which bear upon the first and second edges of the first leg portion when the first leg portion 72 is out of alignment with the edge portions 50 and 52 defining the notch 48. Effectively, the first and second edge portions 50 and 52 are positioned so as to guide the palm-actuated actuator 30 in linear movement generally transversely to the handle 12.

In this embodiment, the palm-actuated actuator 30 is urged outwardly of the handle 12 by a spring 86 having first and second arm portions 88 and 90 and a coiled portion 92, the coiled portion encircling the first mounting boss 29 and the first and second arm portions being connected to and acting between the mounting plate 28 and the first leg portion 72 of the actuator. Referring to FIG. 2, the palm-actuated actuator 30 is prevented from being freed completely away from the handle 12 by a stopper bar 94 having an edge 96 which interferes with a corresponding inside edge 98 on an inside portion of the first plastic cover 24.

After installing the components as described above, the first and second covers 24 and 26 may be reinstalled on the pistol to cover the mounting plate 28 and components mounted thereto, with only the hand contacting portion 76 and small portions of the first and second leg portions 72 (and 74) extending outwardly of the first and second covers and rearwardly of the handle 12.

Figure 4:
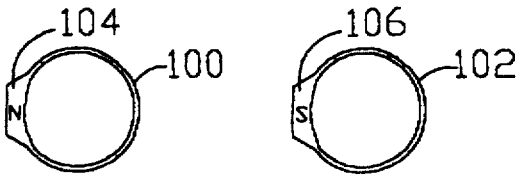
FIG. 4 is a side view of first and second rings according to the first embodiment of the invention.

Referring to FIG. 4, the apparatus further includes first and second rings 100 and 102 operable to be worn on the fingers of the user. First and second ring magnets 104 and 106 are secured to the first and second rings respectively such that the first ring magnet 104 has an outwardly facing North pole and the second ring magnet 106 has an outwardly facing South pole, for cooperation with opposing poles of the first and second mounted magnets 36 and 38 seen in FIG. 1.

Operation

Referring to FIG. 1, to operate the apparatus 10, the user grasps the handle 12 of the pistol and attempts to squeeze the palm-actuated actuator 30 into the handle to push the grip safety actuator 20 into the handle. However, the palm-actuated actuator 30 may only move transversely linearly inward until the abutting edge 84 contacts the first and second blocking edges 60 and 62 of the first and second blocking members 32 and 34 respectively. The first and second blocking edges 60 and 62 interfere with the movement of the first leg portion 72 and therefore the palm-actuated actuator 30 cannot be moved sufficiently to push the grip safety actuator 20 into the handle 12 to enable actuation of the pistol. Hence the first and second blocking members are in their blocking positions and the pistol cannot be fired.

In order to fire the pistol, according to this embodiment, the user wears the first and second rings 100 and 102 shown in FIG. 4 on the middle and fourth fingers that the first and second ring magnets 104 and 106 are disposed adjacent the first and second mounted magnets 36 and 38 disposed on the first and second blocking members 32 and 34 when the user grips the handle 12. The first positioner 79 acts to position the user's hand on the palm-actuated actuator 30 to facilitate natural placement of the user's fingers in the desired positions for positioning of the first and second ring magnets 104 and 106 respectively adjacent the first and second magnets 36 and 38 respectively.

When the user grips the pistol handle 12, the north pole of the first ring magnet 104 attracts the south pole of the first mounted magnet 36 on the first blocking member 32. It will be appreciated that the first magnet is mounted to the first blocking member 32 such that the first blocking member is pivoted about the first hinge when the first ring magnet 104 is sufficiently proximal to the first mounted magnet 36 to influence said mounted magnet by mutual attraction due to the orientation of respective poles of the ring magnet and the mounted magnet. The first blocking member 32 thus rotates away from the handle and out of the notch 48, into a non-interfering or enabling position shown in broken outline in FIG. 2. Referring back to FIG. 1, similarly, the south pole of the second ring magnet 106 attracts the north pole of the second mounted magnet 38 on the second blocking member 34, causing the second blocking member 34 to rotate away from the handle 12 and out of the notch 48 into its enabling position. Hence the blocking edges 60 and 62 of the first and second blocking members 32 and 34 are removed from the path of the first leg portion 72, thereby permitting the first leg portion 72 to be fully received in the notch 48. Hence, the hand contacting portion 76 of the palm-actuated actuator 30 is operable to contact and depress inwardly the grip safety actuator 20 as the user squeezes the handle, thereby rendering the pistol operational. With the grip safety actuator 20 actuated in the manner described, the pistol may be fired upon actuation of the trigger 11.

After firing the pistol, the user relaxes the grip on the handle 12, thereby releasing the palm-actuated actuator 30 from the fully depressed position. The spring 86 urges the palm-actuated actuator 30 outwardly of the handle 12 until the stopper edge 96 contacts the inside edge 98 of the cover 24, in which case the palm-actuated actuator 30 is back in its rest position, as shown in solid outline in FIG. 1.

When the user removes his fingers from the handle 12, the first and second ring magnets 104 and 106 are moved away from the first and second mounted magnets 36 and 38 on the blocking members 32 and 34 and the first and second springs 64 and 66 acting on the first and second blocking members 32 and 34 return the first and second blocking members back into positions in which the first and second blocking edges 60 and 62 are disposed within the notch 48 and hence are again operable to block movement of the first leg portion 72.

It will be appreciated that a similar operating apparatus could be made using first and second magnets of opposite polarity to that described, with of course, first and second ring magnets of opposite polarity. It will be appreciated that for operation similar to that described above, the first and second ring magnets 104 and 106 and first and second mounted magnets 36 and 38 must be of opposite polarity in order to cause attraction therebetween. Preferably, the first and second mounted magnets 36 and 38 on the first and second blocking members respectively are of a strength such that they will not be attracted to a ferrous bar or rod placed adjacent the first cover 24. In this regard magnets available from Master Magnetic Inc. of Castle Rock, Colo. U.S.A. under model number Neodymium 27 have been found to be effective for use in connection with the pistol described above. These magnets have a magnetic field strength of approximately 9300 oersted.

The use of first and second blocking members 32 and 34 and first and second rings 100 and 102 worn by the user require the user to not only have rings with the correct polarity but to ensure the rings are worn on the correct fingers in order to ensure the desired rings are placed adjacent the required positions on the handle for the desired cooperation with the magnets 36 and 38 on the first and second blocking members.

Alternatives

While the above embodiment has been described for use with two rings worn by a user, it would be possible to achieve a similar, result by employing only the first ring 100 and the first blocking member 32. Or, the second blocking member and associated magnet and corresponding ring and ring magnet could be used and the apparatus would work in manner similar to that described above, requiring only one ring to be worn and properly positioned by the user. On mutual repulsion, where the first and second mounted magnets and the first and second ring magnets have like polarities may be used to cause the first and second mounted magnets to be repelled from the first and second ring magnet to cause the first and second blocking members to move into the blocking position.

Figure 5:
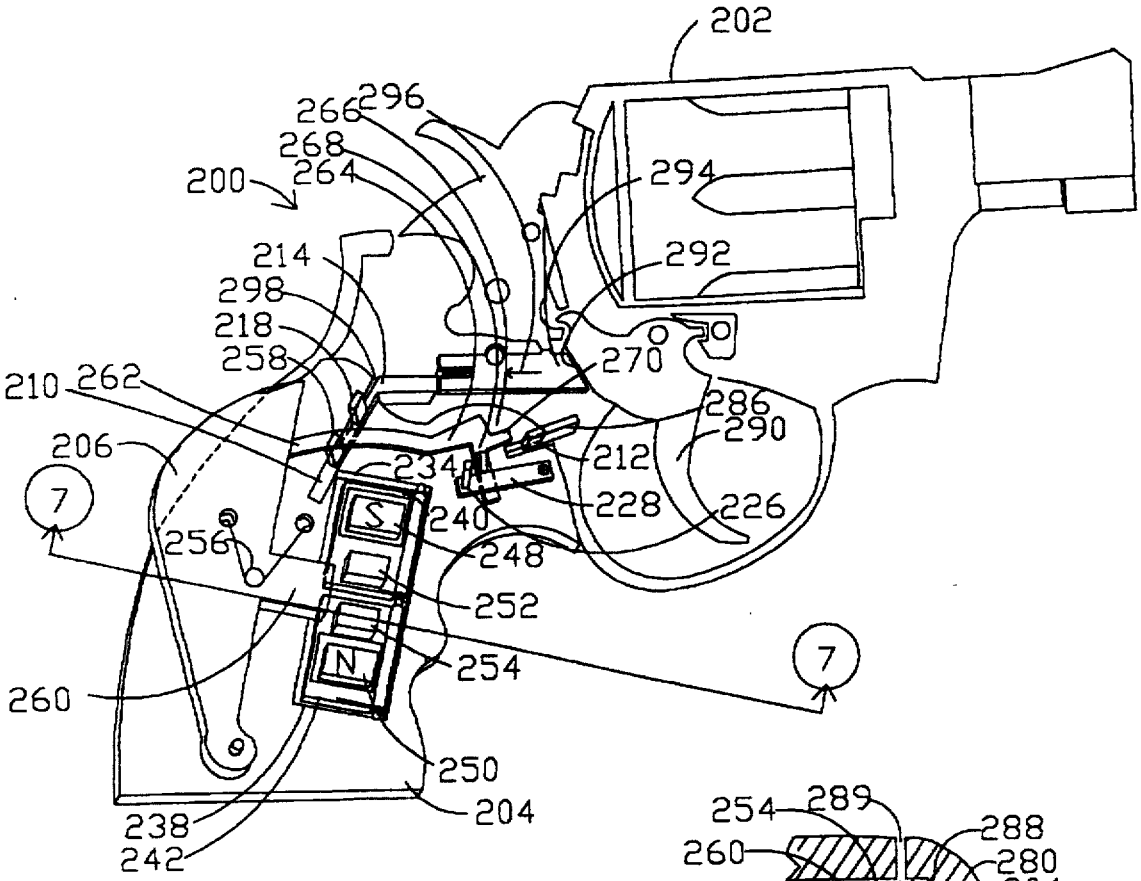
FIG. 5 is a side view of a gun upon which an apparatus according to a second embodiment of the invention is installed.

Referring to FIG. 5, an apparatus according to a second embodiment of the invention is shown generally at 200 installed on a Smith & Wesson M10 double action revolver 202. The apparatus includes a first plastic plate 204 and a palm-actuated actuator member 206 hingedly connected to the first plate. It will be appreciated that the plate may be made of virtually any rigid sheet-like material.

Figure 6:
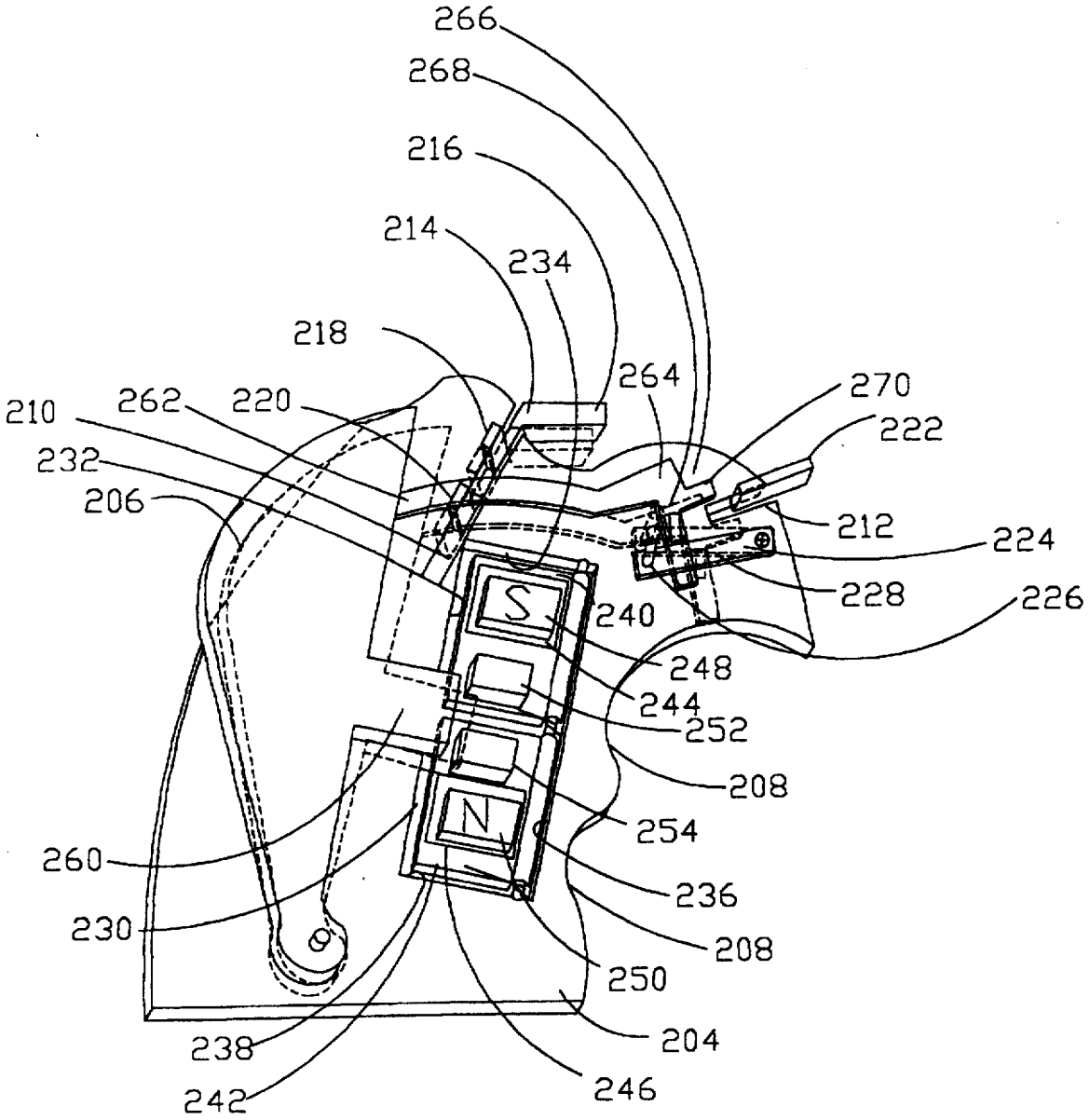
FIG. 6 is a plan view of a plate and actuator according to the second embodiment.

Referring to FIG. 6, the first plate 204 is formed from sheet plastic and is shaped to define a comfortable handle portion with finger locating portions 208 and has first and second slots 210 and 212 disposed generally in an end portion thereof, in the relative locations shown in the Figure. The finger locating portions 208 act as a first positioner on the handle portion, in this embodiment. A stopper plate 214 having a stopper 216 and first and second upstanding guide members 218 and 220 is operable to be received and slidable in the first slot 210. An on/off plate 222 is operable to be received and slidable in the second slot 212. An indicator member 224 having a generally cylindrical ready indicator portion 226 and a flat, flexible arm portion 228 is further secured to the plate 204 such that the flexible arm portion 228 may be flexed away from the plate 204, thereby moving the indicator portion 226 away from the plate.

The first plate 204 further has an opening 230 defined by edges 232, 234, 236, 238. Within the opening 230 are secured first and second hingedly connected blocking members 240 and 242, similar to those described above, including first and second ferrous plate members 244 and 246 and first and second mounted magnets 248 and 250 mounted thereon. The first and second ferrous plates 244 and 246 act to focus the magnetic fields produced by the first and second mounted magnets 248 and 250 away from the metal frame of the gun (not shown in FIG. 6) so that the first and second mounted magnets 248 and 250 are not influenced by the frame.

The blocking members further include blocks 252 and 254 which are secured to the blocking members 240 and 242 adjacent the first and second mounted magnets 248 and 250 respectively.

Referring to FIG. 5, the hingedly connected palm-actuated actuator member 206 is operable to be depressed inwardly relative to the handle of the gun by rotation to the right relative to the plate 204 in the drawing, when the user squeezes the handle. The palm-actuated actuator member 206 is urged outwardly of the handle by a coil spring member 256 acting between the plate 204 and a portion of the actuator member 206.

The palm-actuated actuator member 206 has a projecting arm portion 258 and a projecting tab portion 260. The projecting arm portion 258 includes first and second arm portions 262 and 264. The first arm portion 262 is disposed to extend between the first and second upstanding guide members 218 and 220 of the stopper plate 214. The second arm portion 264 includes a notched portion 266 and a wedge portion 268. The notched portion 266 includes a projection 270 which extends on a first side of the second slot 212 when the lever actuator is in a rest position, the rest position being shown in solid outline in FIG. 5.

Referring to FIG. 6, when the palm-actuated actuator member 206 is pivoted inwardly, clockwise into the orientation shown in broken outline, the first arm portion 262 acts upon the second upstanding guide member 220 to pull the stopper plate 214 inwardly of the plate 204. In addition, when the palm-actuated actuator member 206 is pivoted inwardly, the notched portion 266 moves across the second slot 212 to a position in which the projecting portion 270 extends on an opposite side of the second slot and at the same time, the wedge portion 268 moves to the right, pushing the arm portion 228 upwardly.

Figure 7:
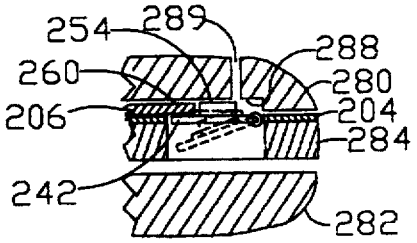
FIG. 7 is a cross-sectional view of a handle portion of the gun of FIG. 5, taken along lines 7—7 of FIG. 5.

Referring to FIG. 7, in the rest position of the palm-actuated actuator member 206, shown in solid outline, the projecting tab portion 260 projects adjacent the first and second blocking members (240 and 242) and toward the first and second blocks (252 and 254), only the second blocking member 242 and second block 254 being shown in the Figure. If the actuator lever is pressed inwardly, the projecting tab portion 260 abuts against the first and second blocks and is prevented from being fully moved to the right in the drawing. However, if the first and second blocking members 240 and 242 are pivoted downward as shown in broken outline, such that the first and second blocks are out of the path of the projecting tab portion 260, the palm-actuated actuator member 206 is operable to be fully rotated to the right in the drawing.

Figure 8:
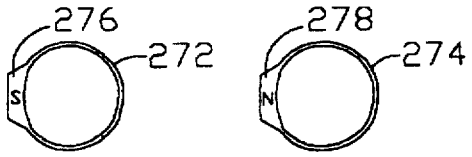
FIG. 8 is a side view of first and second rings according to the second embodiment of the invention.

Referring to FIG. 8, the apparatus according to the second embodiment further includes first and second rings 272 and 274 having first and second magnets 276 and 278 mounted thereon. In this embodiment, the first magnet 276 is mounted on the first ring 272 such that a south pole thereof faces outwardly, while the second magnet 278 is mounted on the second ring 274 such that a north pole thereof faces outwardly.

Operation

In using the apparatus on the Smith & Wesson revolver, wooden handle portions 280 and 282, seen best in FIG. 7, are removed from a handle frame portion 284 of the gun and the first plastic plate 204 with the palm-actuated actuator member 206 mounted thereon is installed on a right-hand side of the handle frame portion 284. Referring to FIG. 5, the stopper plate 214 is then inserted into the first slot 210, under the first arm portion 262 and an on/off switch plate 286 is installed in the second slot 212. Referring to FIG. 7, with the right-hand side wooden handle portion 280 off of the gun, an inner portion 288 thereof is cut away to make room for the plate and components installed thereon. In addition, an opening 289 is cut into the right hand side wooden handle portion 280 to receive the cylindrical ready indicator portion 226 shown in FIG. 5. The cylindrical ready indicator portion 226 extends through the opening in the wooden handle portion 280 when the palm-actuated actuator is fully actuated, to provide tactile feedback to the user to indicate the ready condition to the user. With the wooden handle portion 280 modified as described and the plate 204 installed as described, the wooden handle portions 280 and 282 are reinstalled on the handle frame portion 284.

Referring to FIG. 5, it will be appreciated that the conventional operation of the Smith & Wesson gun involves pulling a trigger 290 having a cam portion 292 which pushes a trigger rebound slide 294 rearwardly of the gun, in the direction of arrow 296. Such movement is however, blocked by the blocking portion of the stopper plate 214, the blocking portion being disposed between an edge portion 298 of the plate 204 and the trigger rebound slide 294. Hence, the trigger 290 cannot be fully pulled or actuated and the gun cannot be fired. The stopper plate 214 thus interferes with the movement of the trigger rebound slide 294 and hence interferes with movement of the trigger.

To operate the apparatus, the user wears the first ring 272, shown in FIG. 8, on the middle finger and the second ring 274 on the fourth finger of the right hand. When the user grips the handle of the gún, the first and second magnets 276 and 278 are disposed adjacent the first and second mounted magnets 248 and 250 of the blocking members 240 and 242. The like poles on corresponding magnets repel the first and second mounted magnets 248 and 250 which causes the blocking members 240 and 242 to rotate counter clockwise into the position shown in broken outline in FIG. 7, wherein the first and second blocking members 240 and 242 are out of the path of the projecting tab portion 260. Referring to FIG. 5, this allows the user to further grip the handle portion such that the palm-actuated actuator member 206 can be pushed inwardly of the handle.

The inward movement of the palm-actuated actuator member 206 moves the first arm portion 262 which moves the stopper plate 214 downwardly in the drawing and out of the path of the trigger rebound slide 294 thereby permitting the trigger 290 to be fully pulled. At the same time, the wedge portion 268 is moved along the arm portion 228, which pushes the indicator portion 226 upwardly, through the opening (289 in FIG. 7) such that the user can feel the ready indicator portion 226 protrude from the wooden cover portion. The user then knows that the gun is ready to fire and the trigger 290 may be fully pulled and the gun fired.

Referring to FIG. 6, if the user wishes to lock the apparatus in a ready-to-fire condition, the on/off switch plate 286 may be pushed into the second slot 212 such that the on/off switch plate 286 interferes with the projecting portion 270 on the second arm portion 264, effectively acting as a hook to prevent movement of the projecting portion 270 past the second slot 212, hence preventing movement of the first arm portion 262 and keeping the stopper plate 214 in the retracted position shown in broken outline in FIG. 6. Referring to FIG. 5, in this position, the stopper plate does not interfere with the trigger rebound slide 294. Thus, in this position, the gun may be fired at will, whether or not the user is wearing the first and second rings 272 and 274.

When the on/off switch plate 286 is moved out of the second slot 212, the projecting portion 270 is free to move past the second slot 212 and the first arm portion 262 is operable to push the stopper plate 214 upwardly back into the position between the edge portion 298 of the plate and the trigger rebound slide 294. In this position, the gun cannot be operated as the trigger 290 cannot be pulled sufficiently to activate the firing mechanism of the gun. If the on/off switch plate 286 is inserted into the second slot 212 when the palm-actuated actuator member 206 is in this position, the actuator cannot be actuated, whether or not the user is wearing the first and second rings 272 and 274, because the projecting portion 270 will interfere with the on/off slide and the on/off slide will not permit the projecting portion 270 to move past the second slot 212. If a user were to place a ferrous material adjacent the cover, the first and second magnets would be attracted upwardly, still in the blocking position.

Alternatively, either the first or the second blocking members 240, 242 can be oriented downwards into the position shown in broken outline in FIG. 7 with the remaining blocking member oriented upwards as shown in solid outline, in which case the user need only wear one of the first and second rings 272 and 274 as necessary to repel whichever blocking member is not disposed downwards, to cause said blocking member to move out of the path of the projecting tab portion 260. In this arrangement, if an unauthorized user should place a ferrous material adjacent the cover (280) so as to attract the first and second mounted magnets 248, 250, the magnet on the downwardly disposed blocking member would be attracted to the ferrous material, thereby raising the downwardly disposed blocking member and providing extra reinforcement for blocking the movement of the projecting tab portion 260 and actuation of the palm-actuated actuator member 206.

Figure 9:
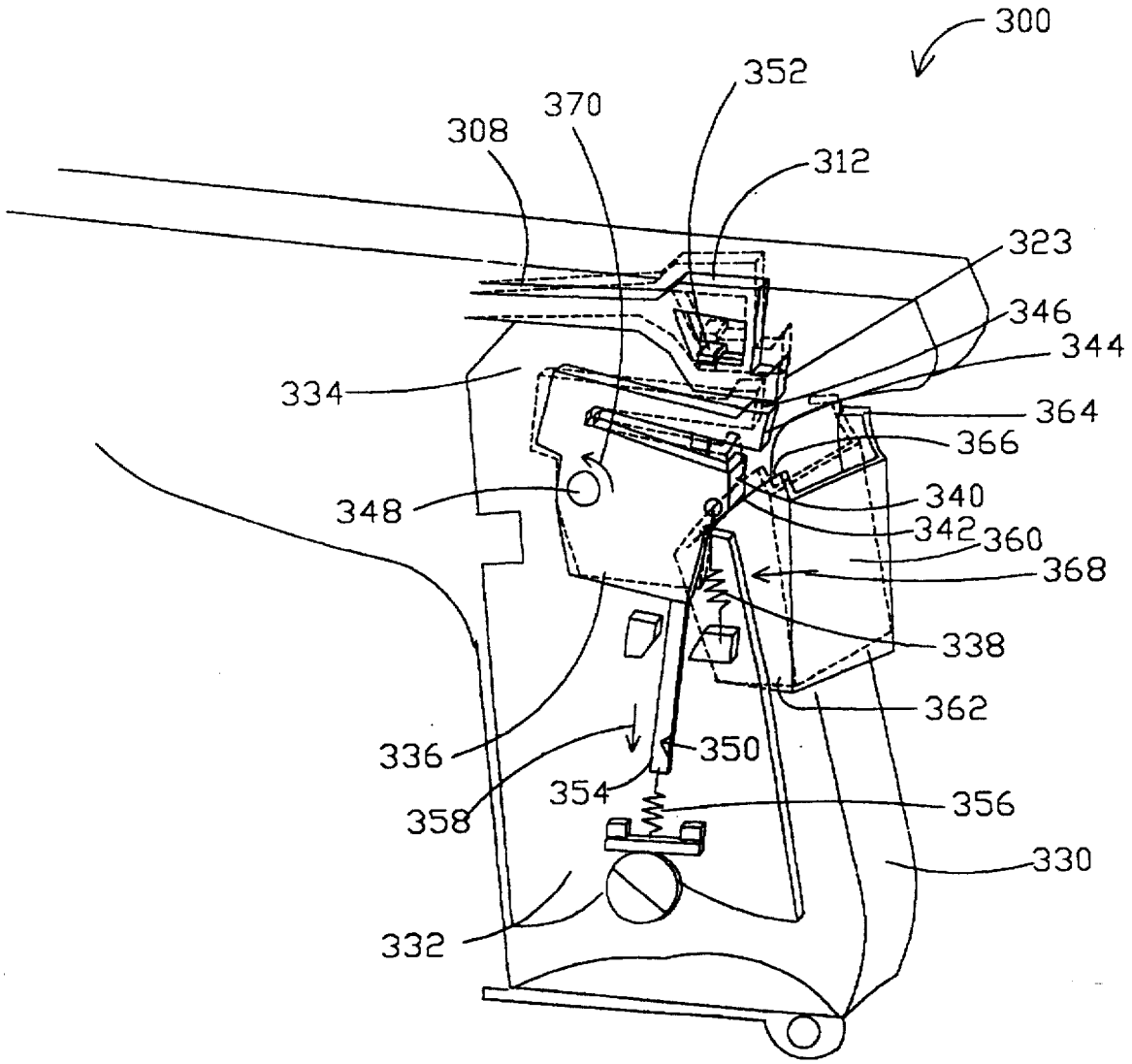
FIG. 9 is a fragmented perspective view of an apparatus according to a third embodiment of the invention, shown mounted on a pistol.

Referring to FIG. 9, an apparatus according to a third embodiment of the invention is shown generally at 300.

Figure 10:
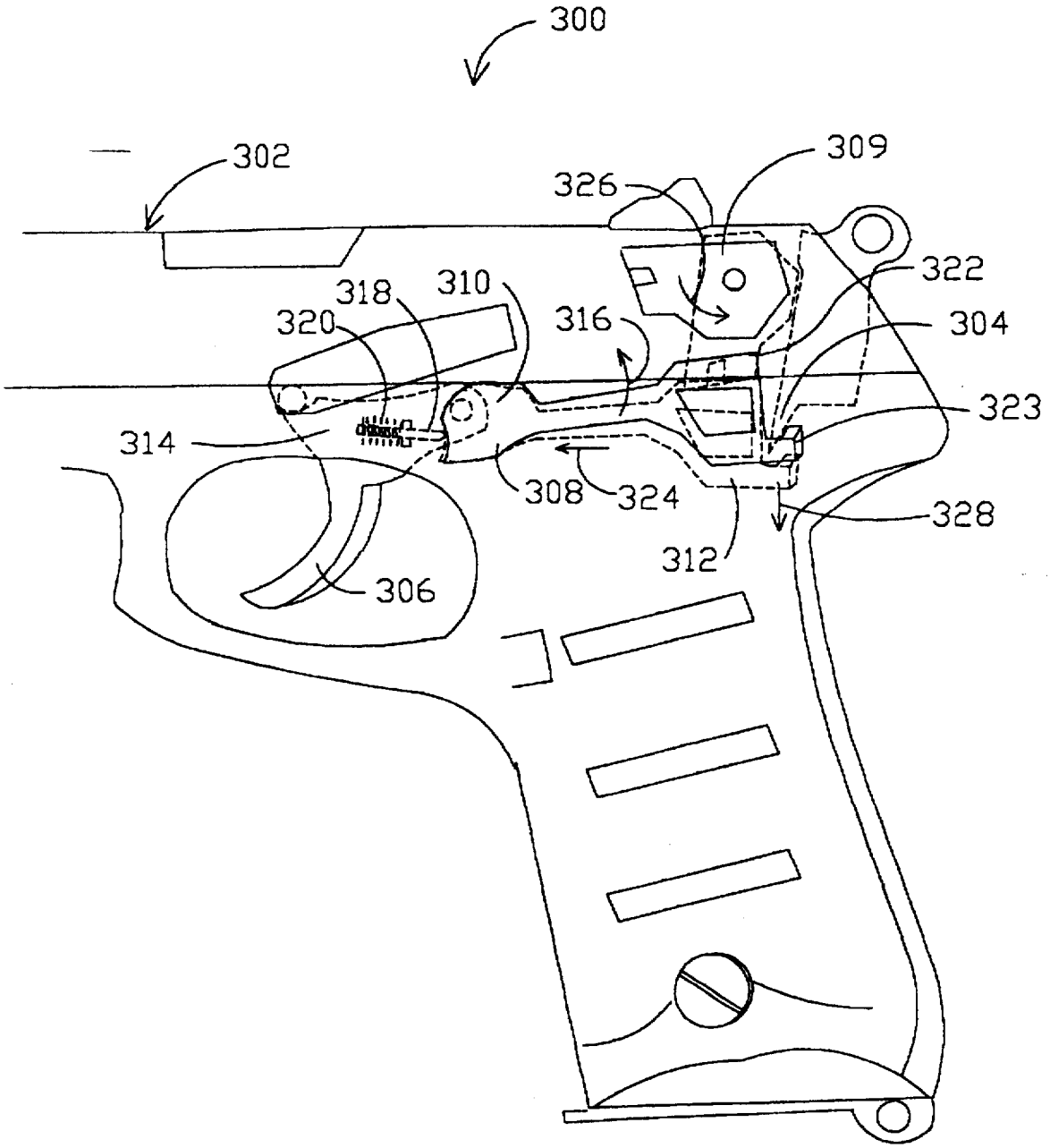
FIG. 10 is a fragmented side view of a pistol according to the prior art.

Referring to FIG. 10, a Ruger P85 double action semi-automatic pistol is shown generally at 302. This type of pistol has a sear 304, a trigger 306, a trigger bar 308 and a safety actuator 309. The trigger bar 308 has a first end portion 310 and a second end portion 312. The first end portion 310 is connected to a lever portion 314 of the trigger 306 and is pivotally forced upwards as shown by arrow 316, by a trigger bar plunger 318 which itself is forced upwards by a spring 320 secured inside the pistol. The second end portion has a protruding portion 322 which projects from the casing and has a hook portion 323 which is operable to engage the sear 304.

In the conventional operation of the pistol, as the trigger 306 is pulled, the trigger bar 308 moves in the direction of arrow 324, engaging the sear 304 to activate the firing mechanism of the pistol. The pistol is rendered inoperational by the safety actuator 309 when the safety actuator is rotated counter-clockwise in the direction of arrow 326 into the position shown in broken outline. In this position, the second end portion 312 is moved downwardly in the drawing in the direction of arrow 328 and the hook portion 323 becomes disengaged with the sear 304 such that when the trigger 306 is pulled and the trigger bar 308 moves in the direction of arrow 324, no contact is made with the sear hence the firing mechanism is not operational. Thus, with this type of pistol, the upward position of the second end portion 312 shown in solid outline is a position in which the pistol is rendered operational and the downward position, shown in broken outline is a position in which the pistol is rendered inoperational.

Referring to FIG. 9, the apparatus according to the fourth embodiment of the invention, acts to pull the second end portion 312 downwardly, as shown in solid outline, to disengage the hook portion 323 from the sear (not shown in FIG. 9) and acts to push the second end portion 312 upwardly as shown in broken outline, in order to engage the hook portion 323 with the sear to activate the firing mechanism. In order to do this, the apparatus is installed on a handle portion 330 of the pistol.

Prior to installation of the apparatus, conventional handle covers are removed from both sides of the handle portion 330 to facilitate installation. The apparatus includes a plate member 332 to which is pivotally secured a riser plate 334. The riser plate includes a first portion 336 to which a spring 338 is connected to pull the riser plate 334 into the position shown in solid outline. The riser plate has a first arm portion 340 having a first edge portion 342 and has a second arm portion 344 having a second edge portion 346. The riser plate is pivotally connected to the plate member 332 by a pivot pin 348.

Further connected to the plate member 332 is a spring loaded trigger bar hold down latch 350 having a first hooked end portion 352 and a second end portion 354. The latch 350 is biased downwardly by a spring 356 connected to the second end portion 354 to place an axially downward force in the direction of arrow 358 on the latch. The first hooked end portion 352 is connected to the second end portion 312 of the trigger bar 308. The latch 350 and spring 356 act to pull the second end portion 312 of the trigger bar 308 into the downward position or non-firing position shown in solid outline in FIG. 9.

Still referring to FIG. 9, the apparatus further includes a palm actuated actuator 360 having first and second leg portions 362 and 364. The first and second leg portions are received on opposite sides of the handle portion 330. The first leg portion has an edge portion 366 which is positioned to contact edge portion 342. Inward movement of the actuator in the direction of arrow 368 causes the edge portion 342 to be cammed upwardly and hence causes rotation of the spring loaded riser plate 334 in the direction of arrow 370. This, causes edge portion 346 to bear upon the second end portion 312 of the trigger bar 308 causing the second end portion 312 to move upwardly into the position shown in broken outline, in which the pistol is rendered operational. Hence, the user must push the palm actuated actuator 360 inwardly in the direction of arrow 368 in order to enable operation of the pistol.

Figure 11:
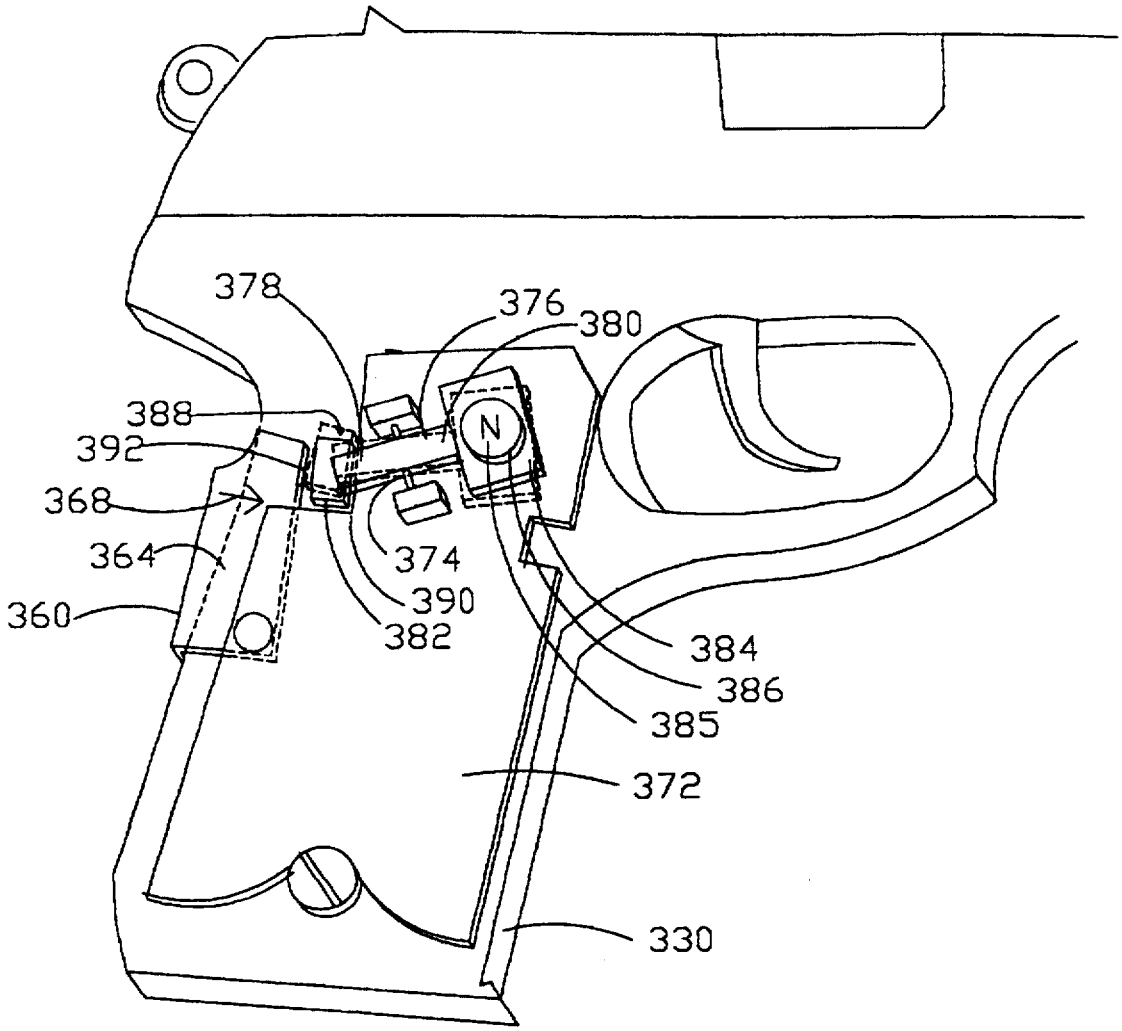
FIG. 11 is a fragmented perspective view of the apparatus and pistol shown in FIG. 9.

Referring to FIG. 11, the apparatus further includes a second plate 372 installed on an opposite side of the handle, upon which is installed a fulcrum shown generally at 374 about which an arm 376 is pivotally connected. The arm has a first end portion 378 and a second end portion 380. The first arm portion has a blocking member 382 secured thereto and the second end portion 380 has a ferrous plate 384 secured thereto and a magnet 386 secured to the ferrous plate 384. The ferrous plate acts as described in connection with the embodiments above, i.e. to reduce the influence of the metal frame of the handle on the magnet 386. The magnet has a North outwardly facing pole 385.

The arm 376 is biased about the fulcrum 374 into the position shown in solid outline. In this position, the blocking member 382 is received in a notched portion 388 of the plate 372 such that it is received between an edge portion 390 of the second plate 372 and an abutting edge portion 392 of the second leg portion 364 of the palm actuated actuator 360.

In addition, the apparats includes any one of the rings shown in FIGS. 4 and 8. However, in this embodiment it is a requirement that the upwardly facing pole on the magnet 386 shown in FIG. 11 have the same polarity as the outwardly facing pole on the chosen ring.

Operation

Referring to FIG. 11, in operation of the apparatus, the user places the appropriate ring chosen from FIGS. 4 or 8 onto the index finger of the right hand and grips the handle portion 330 of the pistol. This positions the ring adjacent the magnet 386 such that like poles on the magnet 386 and the magnet on the ring, repel each other. This repelling action causes the arm 376 to be rotated into the position shown in broken outline which removes the blocking member 382 from between the edge portion 390 and the abutting edge portion 392. The user can then squeeze the handle portion 330 such that the palm actuated actuator 360 moves inwardly in the direction of arrow 368. Referring to FIG. 9, this inward movement of the palm actuated actuator 360 causes edge portion 366 to bear upon edge portion 342 thereby rotating the riser plate 334 in the direction of arrow 370 to cause edge portion 346 to bear upon the second end portion 312 and move the second end portion upwardly into the position shown in broken outline. With the second end portion 312 of the trigger bar 308 in this position, the trigger bar is permitted to engage with the sear and the pistol is rendered operational.

Upon releasing the grip on the handle, the palm actuated actuator 360 is permitted to move outwardly in the direction opposite to that of arrow 368 and moves outwardly due to the camming action between edge portion 342 and edge portion 366 caused by the tendency of spring 338 to rotate the riser plate 334 in a direction opposite to arrow 370. At the same time, the second arm portion 344 moves downwardly toward the position shown in solid outline and the latch 350 pulls the second end portion 312 downwardly into the position shown in solid outline due to the action of spring 356 acting upon the latch and the first hooked end portion 352 of the latch acting on the second end portion 312. Thus, the trigger bar 308 and riser plate 334 are returned to the rest position shown in solid outline in FIG. 9.

Should the user attempt to squeeze the handle to move the palm actuated actuator 360 in the direction of arrow 36 without wearing the ring, referring to FIG. 11, inward movement of the palm actuated actuator 360 in the direction of arrow 368 causes abutting edge portion 392 to bear upon the blocking member 382 disposed between the edge portion 392 and the plate edge portion 390. Thus, inward movement of the palm actuated actuator 360 is blocked, or prevented. Referring back to FIG. 9, when the movement of the palm actuated actuator 360 is blocked, there is nothing to rotate the riser plate 334 in the direction of arrow 370 and, therefore, the second end portion 312 of the trigger bar 308 remains in the position shown in solid outline, out of engagement with the sear (not shown) Hence the pistol is not operational.

Figure 12:
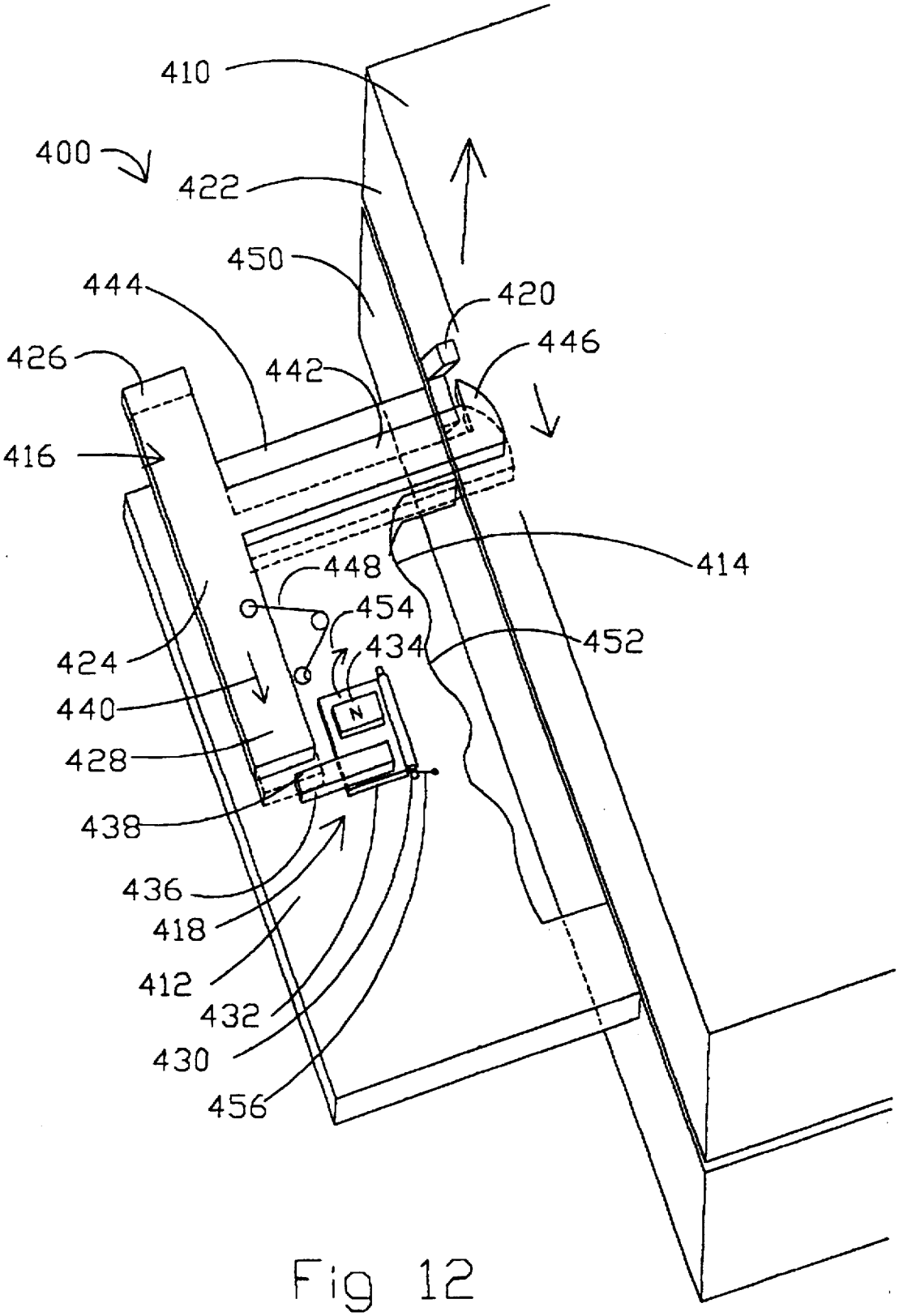
FIG. 12 is a fragmented perspective view of an apparatus according to a fourth embodiment of the invention.

Referring to FIG. 12, an apparatus according to a fourth embodiment of the invention is shown generally at 400. In this embodiment, the apparatus is used on an article of luggage, for example, a briefcase 410 having a handle 412 with finger locating contours 414.

In this embodiment, the apparatus includes a T-member 416, a blocking member shown generally at 418 and a latch portion shown generally at 420. The T-member 416, and blocking member 418 are disposed in the handle 412 whereas the latch portion 420 is disposed on an upper cover or separable portion of the briefcase, the upper cover portion being shown generally at 422.

The T-member includes a main bar portion 424 having first and second opposite end portions 426 and 428. The first end portion 426 extends through an opening in the handle 412 and is accessible to be operated by a thumb of a user. The first end portion therefore acts as a thumb actuated actuator. The second end portion 428 extends into the handle 412 and is operable to cooperate with the blocking member 418. The blocking member includes a hinge pin 430 secured to the handle 412. A flap 432 is hingedly secured to the pin 430 and is operable to rotate relative thereto. The pin 430 thus acts as a first hinge. A first mounted magnet 434 is secured to the flap 432, with a north pole thereof facing upwardly, perpendicularly to the plane of the handle 412. A first block 436 is secured to the flap 432 and has a first end portion 438 which extends outwardly of the flap 432, into the path of the second end portion 428. When the first end portion 438 extends in this manner, the blocking member is said to be in a blocking position in which movement of the T-member 416, in the direction of arrow 440, is prevented by interference between the first end portion 438 and the second end portion 428.

The T-member 416 has a perpendicularly extending leg portion 442 which extends along an arm portion 444 of the handle 412 and which terminates in a hook portion 446 which is operable to engage with the latch 420. A spring 448 is secured between the T-member 416 and the handle 412 so as to urge the T-member 416 in a direction opposite to the direction indicated by arrow 440. With the T-member so urged, the hook portion 446 is engaged with the latch 420 and the upper cover portion 422 of the briefcase 410 cannot be separated from a bottom separable portion 450 thereof, in the conventional manner.

Operation

In operating the device, the user wears a ring as described in FIG. 4 above, on the middle finger of the right hand. The user then grasps the handle such that the fingers are received in the finger locating contours 414 with the middle finger wearing the ring being received in a central indentation 452. The central indentation thus acts as a first positioner, for positioning at least one of the user's fingers in proximity to the first mounted magnet such that when the adjacent magnet on the ring worn by the user the adjacent magnet is disposed in proximity to the first mounted magnet when the user's finger is located in the first positioner. This positions the magnet on the ring of FIG. 4 adjacent the first mounted magnet 434 and as the magnets have opposite polarities the ring magnet attracts the mounted magnet thereby pivoting the flap 432 upwardly about the hinge pin 430 in the direction of arrow 454. Hence the blocking member is pivoted about the hinge when the first adjacent magnet is proximal to the mounted magnet. This moves the first end portion 438 out of the path of the second end portion 428 and allows the user to push the first end portion 426 inwardly in the direction of arrow 440, against the urging of the spring 448. This movement is simultaneously observed by the leg portion 442 which moves the hook portion 446 out of engagement with the latch 420, thereby enabling the upper cover portion 422 to be separated from the bottom portion 450 of the briefcase.

Upon the user releasing his thumb from the first end portion 426, the spring 448 urges the T-member 416 in a direction opposite to arrow 440. This moves the T-member and connected leg portion 442 back to engagement with the latch 420, if the upper cover portion 422 is in the position shown, or simply returns the hook portion 446 into the position shown in solid outline when the upper cover portion 422 is separated from the bottom portion 450. Upon the user releasing his grip from the handle 412, the ring magnet is further displaced from the first mounted magnet 434 thereby breaking the attraction between the magnets. A spring 456 acting between the handle portion and the flap 432 acts to return the flap 432 into the blocking position shown in which the T-member 416 is blocked from moving in the direction of arrow 440.

In the event that an unauthorized user, not wearing a ring in accordance with FIG. 4, grasps the handle 412, attempts to push the first end portion 426 with the thumb are impeded as movement of the T-member 416 is prevented by the second end portion 428 of the T-member 416 being blocked by the first end portion 438. Hence, the T-member is prevented from moving in the direction of arrow 440 and the hook portion 446 cannot be disengaged from latch 420 and the upper cover portion 422 may not be separated from the bottom portion 450.

In an alternative embodiment, mutual repulsion between like poles on the magnet on the ring and the first mounted magnet 434 may be used to cause the flap 432 to be pushed downwardly instead of attracted upwardly out of the path of the second end portion 428.

While specific embodiments of the invention have been described and illustrated, such embodiments should be considered illustrative of the invention only and not as limiting the invention as construed in accordance with the accompanying claims.

What is claimed is:

1. A locking apparatus for use on a device having a handle operable to be gripped by a user's hand, the apparatus comprising:

a) a moveable palm-actuated actuator operable to be moved by a user's palm when gripping the handle and operable to actuate said device;

b) a first moveable blocking member connected to the handle and operable to be moved into an enabling position in which movement of said movable actuator is enabled and a blocking position in which movement of said palm-actuated actuator member is blocked by the blocking member interfering with movement of said palm-actuated actuator;

c) a first mounted magnet connected to said first blocking member and disposed in a position on said handle such that at least one of a user's fingers will be adjacent said first mounted magnet when the handle is gripped, said first mounted magnet being operable to cooperate with a first adjacent magnet placed adjacent thereto to move said first blocking member between said blocking and enabling positions.

2. An apparatus as claimed in claim 1 wherein said palm actuated actuator is movably connected to said handle such that when said handle is squeezed, said palm actuated actuator is moved relative to the handle.

3. An apparatus as claimed in claim 2 further including a first positioner, for positioning at least one of the user's fingers in proximity to said first mounted magnet such that when said adjacent magnet is on a first ring worn on said at least one of said user's fingers, said first adjacent magnet is disposed in proximity to said first mounted magnet when said at least one of the user's fingers is located in said first positioner.

4. An apparatus as claimed in claim 3 wherein said first positioner is disposed on said palm-actuated actuator.

5. An apparatus as claimed in claim 3 wherein said positioner is on said handle.

6. An apparatus as claimed in claim 1 further including a first hinge for hingedly connecting said first blocking member to said handle.

7. An apparatus as claimed in claim 6 wherein said first mounted magnet is mounted to said first blocking member such that said first blocking member is pivoted about said first hinge when the first adjacent magnet is proximal to said first mounted magnet.

8. An apparatus as claimed in claim 1 wherein said first mounted magnet and said first adjacent magnet have opposite polarities such that said first mounted magnet is attracted to said first adjacent magnet to cause said first blocking member to move into said enabling position.

9. An apparatus as claimed in claim 1 wherein said first mounted magnet and said first adjacent magnet have like polarities such that said first mounted magnet is repelled from said first adjacent magnet to cause said first blocking member to move into said enabling position.

10. An apparatus as claimed in claim 1 further including a ready indicator on said handle, said ready indicator being operable to be extended when said palm actuated actuator is fully actuated, to provide tactile feedback to the user to indicate same.

11. An apparatus as claimed in claim 1 further including:

a) a second moveable blocking member connected to the handle and operable to be moved into an enabling position in which movement of said movable actuator is enabled and a blocking position in which movement of said moveable actuator is blocked; and b) a second mounted magnet on said second blocking member, said second mounted magnet being operable to cooperate with a second adjacent magnet placed adjacent thereto such that said second blocking member is moved between said enabling and blocking positions.

12. An apparatus as claimed in claim 11 further including a second positioner for positioning at least one of the user's fingers in proximity to said second mounted magnet.

13. An apparatus as claimed in claim 11 further including a second hinge for hingedly connecting said second blocking member to said handle.

14. An apparatus as claimed in claim 11 wherein said second mounted magnet and said second adjacent magnet have opposite polarities such that said second mounted magnet is attracted to said second adjacent magnet to cause said blocking member to move into said enabling position.

15. An apparatus as claimed in claim 11 wherein said second mounted magnet and said second adjacent magnet have like polarities such that said second mounted magnet is repelled from said second adjacent magnet to cause said blocking member to move into said enabling position.

16. An apparatus as claimed in claim 11 wherein said a) said first mounted magnet and said first adjacent magnet have opposite polarities such that said first mounted magnet is attracted to said first adjacent magnet to cause said first blocking member to move into said enabling position; and b) said second mounted magnet and said second adjacent magnet have like polarities such that said second mounted magnet is repelled from said second adjacent magnet to cause said blocking member to move into said enabling position.

17. An apparatus as claimed in claim 11 wherein:

a) said first mounted magnet and said first adjacent magnet have like polarities such that said first mounted magnet is repelled from said first adjacent magnet to cause said blocking member to move into said enabling position; and b) said second mounted magnet and said second adjacent magnet have opposite polarities such that said second mounted magnet is attracted to said second adjacent magnet to cause said blocking member to move into said enabling position.

18. A locking apparatus for use on a handle operable to be gripped by a user's hand, the apparatus comprising:

a) a palm-actuated actuator movably connected to said handle, such that when said handle is squeezed, said palm actuated actuator is moved relative to the handle;

b) first and second moveable blocking members movably connected to said handle, said first and second movable blocking members being operable to be moved into respective enabling positions in which movement of said movable actuator is enabled and respective blocking positions in which movement of said palm-actuated actuator is blocked;

c) first and second mounted magnets on said first and second blocking members respectively, said first and second mounted magnets being disposed in a position on said handle such that two of a user's fingers will be adjacent said first and second mounted magnets respectively when the handle is gripped, said first and second mounted magnets being operable to cooperate with first and second adjacent magnets respectively when said first and second adjacent magnets are placed adjacent thereto such that said first and second blocking members are moved between said enabling and blocking positions.

19. An apparatus as claimed in claim 18 further including first and second positioners on said handle, for positioning said two of the user's fingers in proximity to said first and second mounted magnets respectively, such that when said adjacent magnets are on first and second rings worn on said two of said user's fingers, said first and second adjacent magnets are disposed in proximity to said first and second mounted magnets respectively when said two of the user's fingers are located in said first and second positioners respectively.

20. A method of unlocking an actuator on a handle, the method comprising the steps of:

a) gripping the handle such that an adjacent magnet on a finger ring worn by a user is placed adjacent a mounted magnet on said handle;

b) attracting said mounted magnet with said adjacent magnet thereby moving a first blocking member out of a path of a palm-actuated actuator on said handle;

c) squeezing said handle and said palm-actuated actuator to move said palm-actuated actuator in the path, relative to said handle.

21. A locking apparatus for use on a device having a handle operable to be gripped by a user's hand, the apparatus comprising:

a) a moveable thumb-actuated actuator operable to be moved by a user's thumb when gripping the handle and operable to actuate said device;

b) a first moveable blocking member connected to the handle and operable to be moved into an enabling position in which movement of said movable actuator is enabled and a blocking position in which movement of said thumb-actuated actuator is blocked by the blocking member interfering with movement of said thumb-actuated actuator;

c) a first mounted magnet connected to said first blocking member and disposed in a position on said handle such that at least one of a user's fingers will be adjacent said first mounted magnet when the handle is gripped, said first mounted magnet being operable to cooperate with a first adjacent magnet placed adjacent thereto to move said first blocking member between said blocking and enabling positions.

22. An apparatus as claimed in claim 21 wherein said thumb actuated actuator is movably connected to said handle such that when the user's thumb is retracted relative to the handle, said thumb actuated actuator is moved relative to the handle.

23. An apparatus as claimed in claim 21 further including a first positioner, for positioning at least one of the user's fingers in proximity to said first mounted magnet such that when said adjacent magnet is on a first ring worn on said at least one of said user's fingers, said first adjacent magnet is disposed in proximity to said first mounted magnet when said at least one of the user's fingers is located in said first positioner.

24. An apparatus as claimed in claim 23 wherein said positioner is on said handle.

25. An apparatus as claimed in claim 21 further including a first hinge for hingedly connecting said first blocking member to said handle.

26. An apparatus as claimed in claim 25 wherein said first mounted magnet is mounted to said first blocking member such that said first blocking member is pivoted about said first hinge when the first adjacent magnet is proximal to said first mounted magnet.

27. An apparatus as claimed in claim 21 wherein said first mounted magnet and said first adjacent magnet have opposite polarities such that said first mounted magnet is attracted to said first adjacent magnet to cause said first blocking member to move into said enabling position.

28. An apparatus as claimed in claim 21 wherein said first mounted magnet and said first adjacent magnet have like polarities such that said first mounted magnet is repelled from said first adjacent magnet to cause said first blocking member to move into said enabling position.

* * * * *